US010421108B2

(12) United States Patent
Kerska

(10) Patent No.: US 10,421,108 B2
(45) Date of Patent: Sep. 24, 2019

(54) SEALANT SYSTEM FOR METAL SEAMS

(71) Applicant: Steven Kerska, Cedar Rapids, IA (US)

(72) Inventor: Steven Kerska, Cedar Rapids, IA (US)

(73) Assignee: MESTEK MACHINERY, INC., Westfield, MA (US)

( * ) Notice: Subject to any disclaimer, the term of this patent is extended or adjusted under 35 U.S.C. 154(b) by 628 days.

(21) Appl. No.: 14/986,770

(22) Filed: Jan. 4, 2016

(65) Prior Publication Data

US 2016/0214134 A1 Jul. 28, 2016

Related U.S. Application Data

(60) Provisional application No. 62/106,906, filed on Jan. 23, 2015.

(51) Int. Cl.

| | |
|---|---|
| ***B05B 7/16*** | (2006.01) |
| ***B05C 11/10*** | (2006.01) |
| ***B21C 37/10*** | (2006.01) |
| ***B05C 5/02*** | (2006.01) |
| ***B05C 9/04*** | (2006.01) |
| *B05C 13/00* | (2006.01) |

(52) U.S. Cl.

CPC ..... *B21C 37/104* (2013.01); *B05B 7/16* (2013.01); *B05C 5/0245* (2013.01); *B05C 9/04* (2013.01); *B05C 11/1015* (2013.01); *B05C 13/00* (2013.01)

(58) Field of Classification Search

USPC ..... 118/302, 666, 667

See application file for complete search history.

(56) References Cited

U.S. PATENT DOCUMENTS

| | | | | |
|---|---|---|---|---|
| 2,805,638 A * | 9/1957 | Morin | ..... | B65B 17/02 118/241 |
| 5,100,699 A * | 3/1992 | Roeser | ..... | B29B 7/749 118/302 |
| 6,514,569 B1 * | 2/2003 | Crouch | ..... | B05C 5/0208 222/134 |

* cited by examiner

*Primary Examiner* — Yewebdar T Tadesse

(74) *Attorney, Agent, or Firm* — Grogan, Tuccillo & Vanderleeden, LLP

(57) ABSTRACT

A sealant system for operation with a metal workpiece comprises a frame, a cam assembly mounted to said frame, a sealant reservoir, a sealant application unit connected to said sealant reservoir, and a control module for coordinating operation of said cam assembly and said sealant reservoir, wherein said control module comprises a temperature sensor for monitoring the temperature of said sealant, an integrated heating system for heating said sealant and a controller in communication with said temperature sensor and said integrated heating system.

1 Claim, 9 Drawing Sheets

20
12

10
22
22
16

SEALANT SYSTEM FOR METAL SEAMS

CROSS-REFERENCE TO RELATED APPLICATIONS

This application claims the benefit of U.S. Provisional Application Ser. No. 62/106,906, filed on Jan. 23, 2015, which is herein incorporated by reference in its entirety.

FIELD OF THE INVENTION

The present invention relates generally to a sealant system and, more particularly, to a sealant system for metal seams in ductwork.

BACKGROUND OF THE INVENTION

Ductwork in HVAC applications is typically formed by rollforming metal workpieces into square, rectangular or round ducts. As a function of their manufacture, these formed metal ducts have matching seams that must be joined to one another to complete the finished profile of the ductwork.

Incident to joining the seam of many metal ducts is the requirement that a sealant be interposed within the joined seam, in order to make the ductwork more airtight and efficient. Existing system deploy a supply of sealant to a nozzle assembly, and attempt to apply the sealant along the joined seam to effectuate this sealant operation.

Problems, however, exist in the art, as known sealant systems are plagued with excessive stringing of the sealant, when the injection nozzle is moved away from the joined seam. In addition, known systems suffer when ambient environmental conditions case the sealant utilized to become warmer or colder than desired, making the application of the sealant difficult and sometimes completely insufficient.

There therefore exists a need within the industry for the ability to increase the effectiveness of a sealant system for metal seam, while avoiding the abovementioned drawbacks of known sealant systems.

SUMMARY OF THE INVENTION

With the forgoing concerns and needs in mind, it is the general object of the present invention to provide a sealant system.

It is another object of the present invention to provide a sealant system for metal seams of a duct.

It is another object of the present invention to provide a sealant system for metal seams of a duct that avoids problematic stringing of the sealant when the injection nozzle of the sealant system has finished its sealing operation.

It is another object of the present invention to provide a sealant system for metal seams of a duct that is capable of recognizing a particular type of sealant that is being utilized, and which maintains a particular sealant at a predetermined temperature, to provide for proper viscosity of the sealant during application.

It is another object of the present invention to provide a sealant system for metal seams of a duct that is integrated with the roll forming machine itself, yet does not interfere with the cam rollers of the roll forming machine.

These and other objectives of the present invention, and their preferred embodiments, shall become clear by consideration of the specification, claims and drawings taken as a whole.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENT

Figure 1:
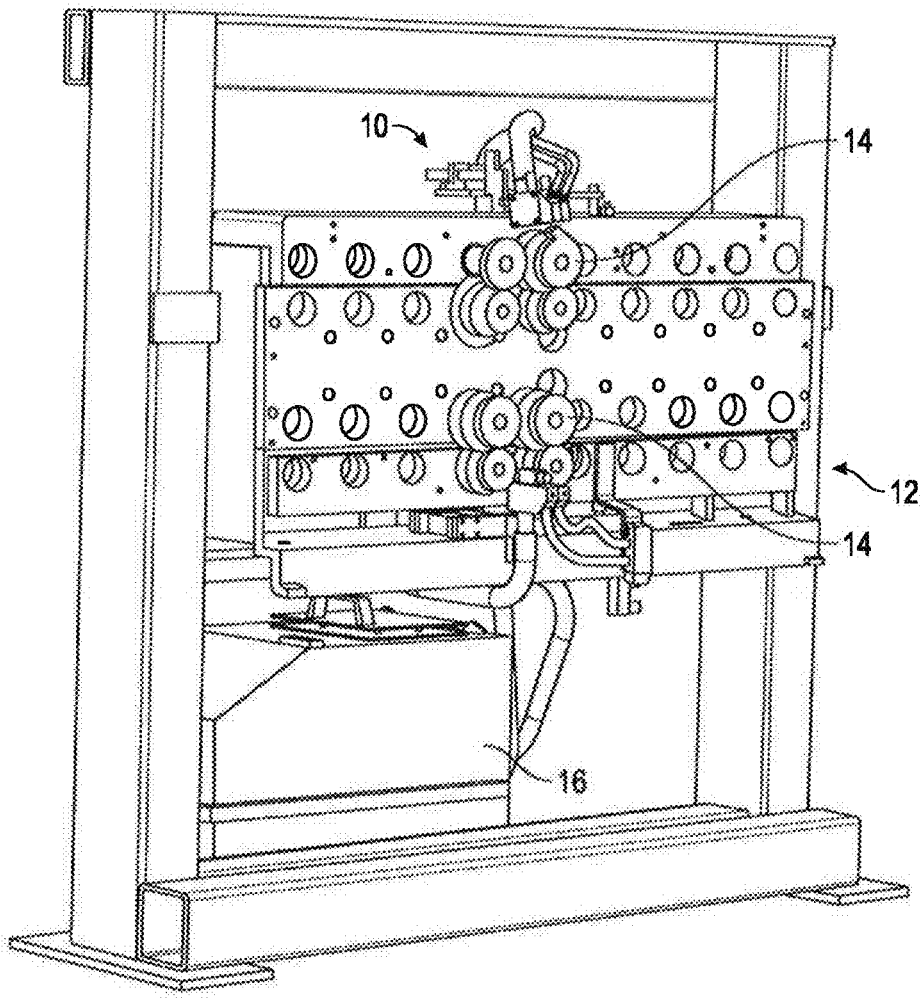
FIG. 1 illustrates an isomeric, side view of a sealant system, according to one embodiment of the present invention.

FIG. 1 illustrates an isomeric, side view of a sealant system 10, according to one embodiment of the present invention. In particular, FIG. 1 illustrates the sealant system 10, as integrated with a known roll forming machine and frame 12. As will be appreciated, the roll forming machine and frame 12 is only partially shown in FIG. 1, so as to permit illustration of the sealant system itself, and its preferred placement with respect to the cam rollers 14 of the roll forming machine and frame 12.

While the present invention is being described in connection with the partial roll forming machine and frame 12 shown in FIG. 1, it will be readily appreciated by one of ordinary skill in the art that the present sealant system 10 could be integrated into any roll forming machine, regardless of the specific type of the same, without departing from the broader aspects of the present invention.

Also shown in FIG. 1 is a sealant supply and control module 16, arranged in close association with the body of the roll forming machine and frame 12.

Figure 2:
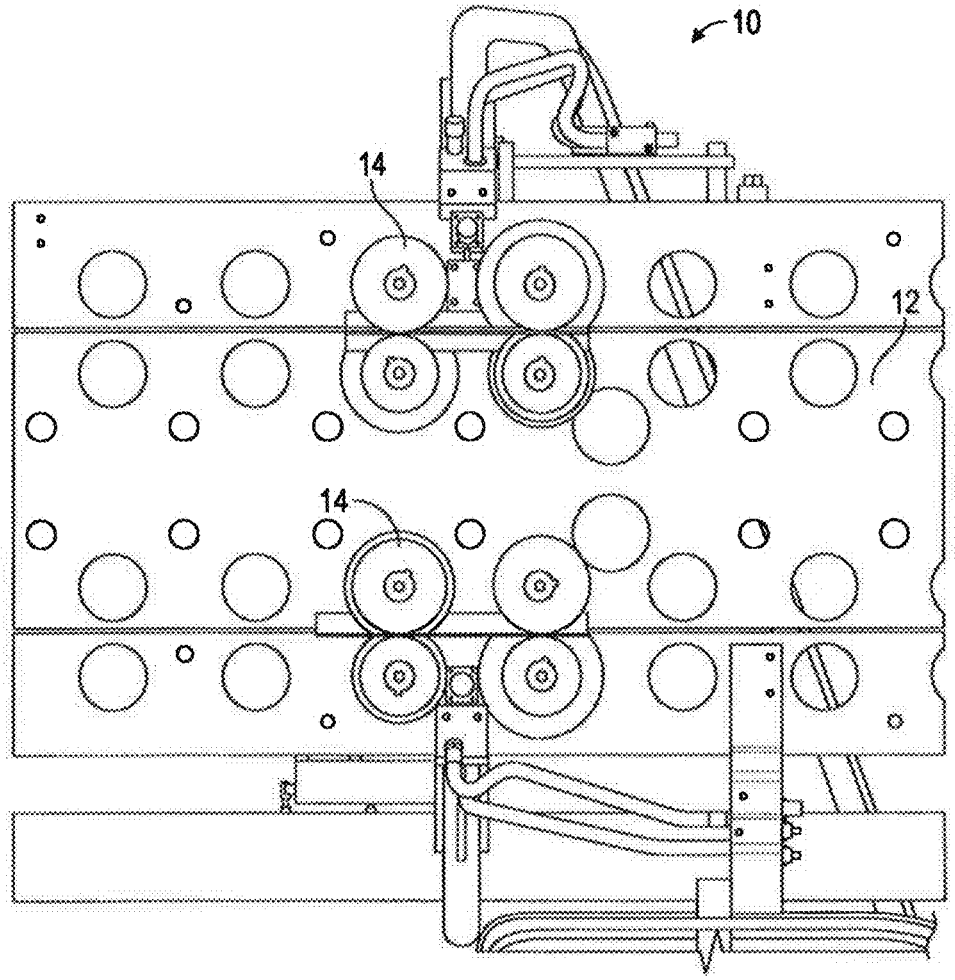
FIG. 2 is an enlarged view of the sealant system, shown in FIG. 1.
Figure 3:
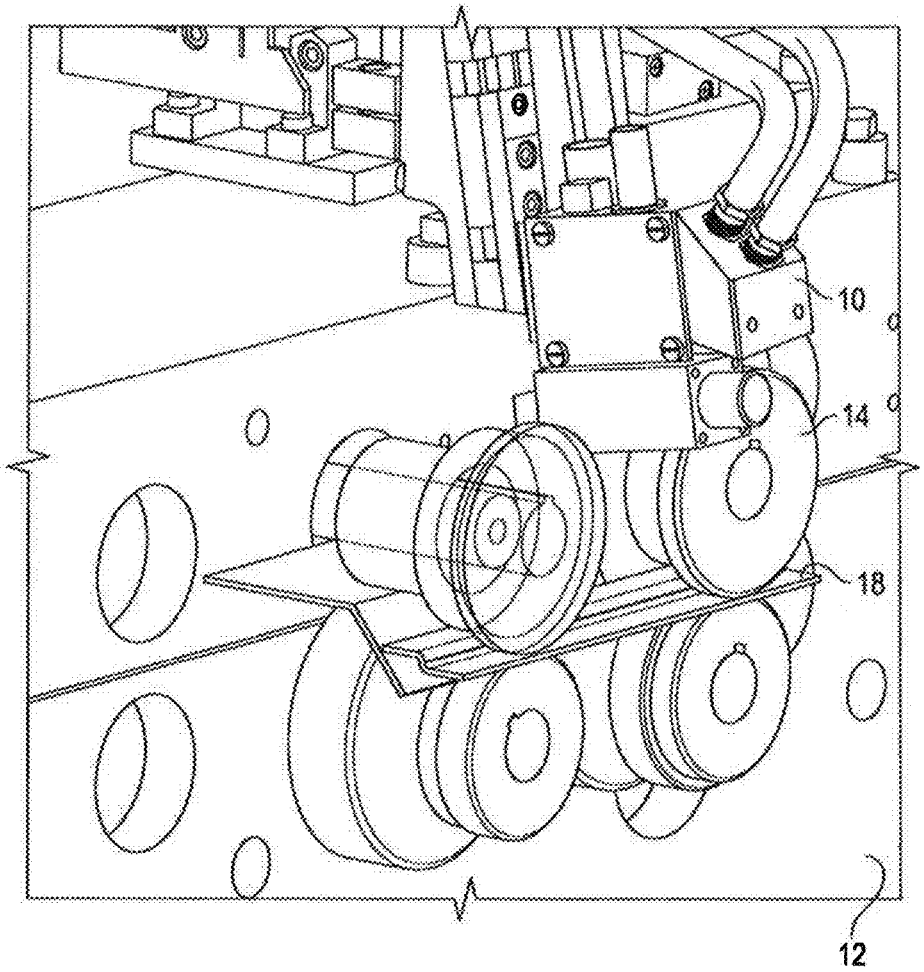
FIG. 3 illustrates the sealant system of FIGS. 1 and 2 as it is deploying sealant into the joined seam of the metal workpiece.

FIG. 2 is an enlarged view of the sealant system 10 shown in FIG. 1, while FIG. 3 illustrates the sealant system 10 of FIGS. 1 and 2 as the sealant system 10 is deploying sealant into the joined seam of the metal workpiece 18.

As most clearly shown in FIGS. 1 and 2, the sealant system 10 of the present invention may be mounted to both upper and lower cam rollers 14, so as to simultaneously seal upper and lower seams of a metal duct, or to seam either the upper or lower seam of a metal duct, as desired.

Figure 4:
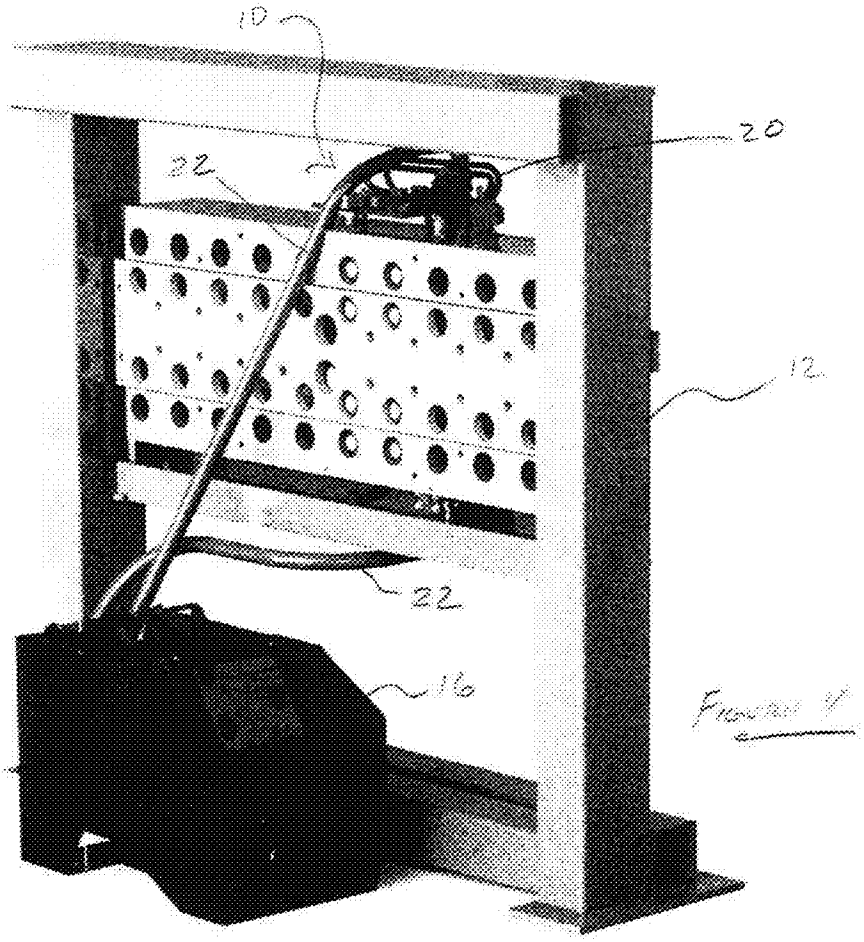
FIG. 4 illustrates the back side of the sealant system, and roll forming machine and frame, as shown in FIGS. 1 and 2.
Figure 5:
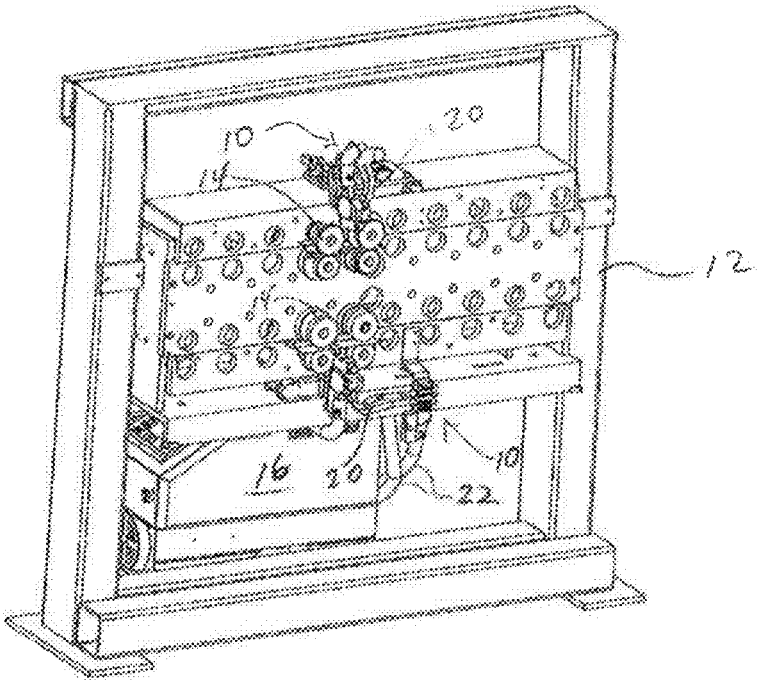
FIGS. 5 illustrates the sealant system, and sealant supply and control module, as shown in FIGS. 1-4, in greater detail.

FIG. 4 illustrates the back side of the sealant system 10 and roll forming machine and frame 12, as shown in FIGS. 1 and 2. As shown in FIG. 4, the sealant supply and control module 16 is preferably disposed on the side opposite of the roll forming machine and frame 12, so as to isolate the sealant supply and control module 16 from the operative portions of the roll forming machine while the roll forming machine 12 is forming and joining the metal duct via the incorporated cam rollers 14.

As also shown in FIG. 4, the sealant supply and control module 16 provides a predetermined sealant to nozzle lines 20 of the sealant system 10, via sealant supply tubes 22.

It is am important aspect of the present invention that the sealant supply and control module includes a controller and temperature sensor to constantly monitor the temperature of the sealant that is carried by the sealant supply hoses 22. Moreover, the controller of the sealant supply and control module 16 is in communication with an integrated heating source for selectively heating the sealant supply within the sealant supply and control module 16, thereby ensuring that the proper temperature of each particular sealant utilized is maintained throughout the application of a particular sealant.

It is another important aspect of the present invention that the sealant system 10 ensures that regardless of the specific type of sealant utilized, and regardless of the ambient temperature of the environment in which the sealant system 10 is employed, that the sealant itself will always be of the proper temperature, to ensure proper viscosity of the sealant during its application to a seam or the like.

It should also be noted that the sealant system 10 of the present invention has arranged for the sealant supply hoses 22 to be connected to the bottom of the sealant reservoir located within the housing of the sealant supply and control module 16. By connecting the sealant supply hoses to the bottom of the sealant reservoir, the present invention effectively avoids the presence of damaging air pockets or bubbles in the sealant being supplied through the sealant supply hoses 22.

FIGS. 5-10 illustrate, in combination, the sealant system 10 and sealant supply and control module 16, in greater detail.

It is yet another important aspect of the present invention that due to the specific location of the nozzle lines 20 being in close association with the cam rollers 14 as well as the seam of the metal workpiece 18, the sealant system 10 of the present invention effectively avoids any messy and damaging stringing of extraneous sealant material, upon completion of a sealing operation.

Figure 6:
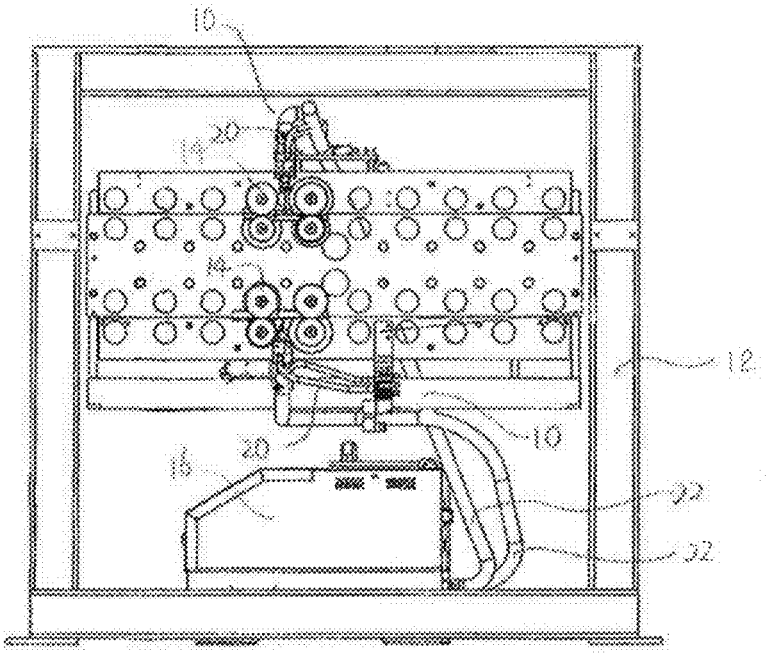
FIG. 6 is a front elevational view of a sealant system in accordance with one embodiment of the present invention.

FIG. 6 is a front elevational view of a sealant system in accordance with one embodiment of the present invention. FIG. 6 illustrates the the sealant system 10, as integrated with a known roll forming machine and frame 12. Two cam rollers 14, one at an upper position and one at a lower position, are mounted on to frame 12. Each of the cam roller 14 is associated with the sealant system 10, so as to simultaneously seal upper and lower seams of a metal duct, or to seam either the upper or lower seam of a metal duct, as desired.

The control module 16 is arranged in close association with the body of the roll forming machine and frame 12. The control module 16 provides a predetermined sealant to the sealant system 10 via the sealant supply hoses 22 which are connected to the bottom of the sealant reservoir located within the housing of the control module 16. It shall be understood by the person having ordinary skill in the art that the sealant reservoir can either locates within the housing of the control module 16, or locates outside the housing of the control module but in a close association with the roll forming machine and frame 12 or the sealant system 10.

The controller and the temperature sensor included by the control module constantly monitors the temperature of the sealant within the control unit 16 and the sealant reservoir, as well as the temperature of the sealant that is carried by the sealant supply hoses 22.

Figure 7:
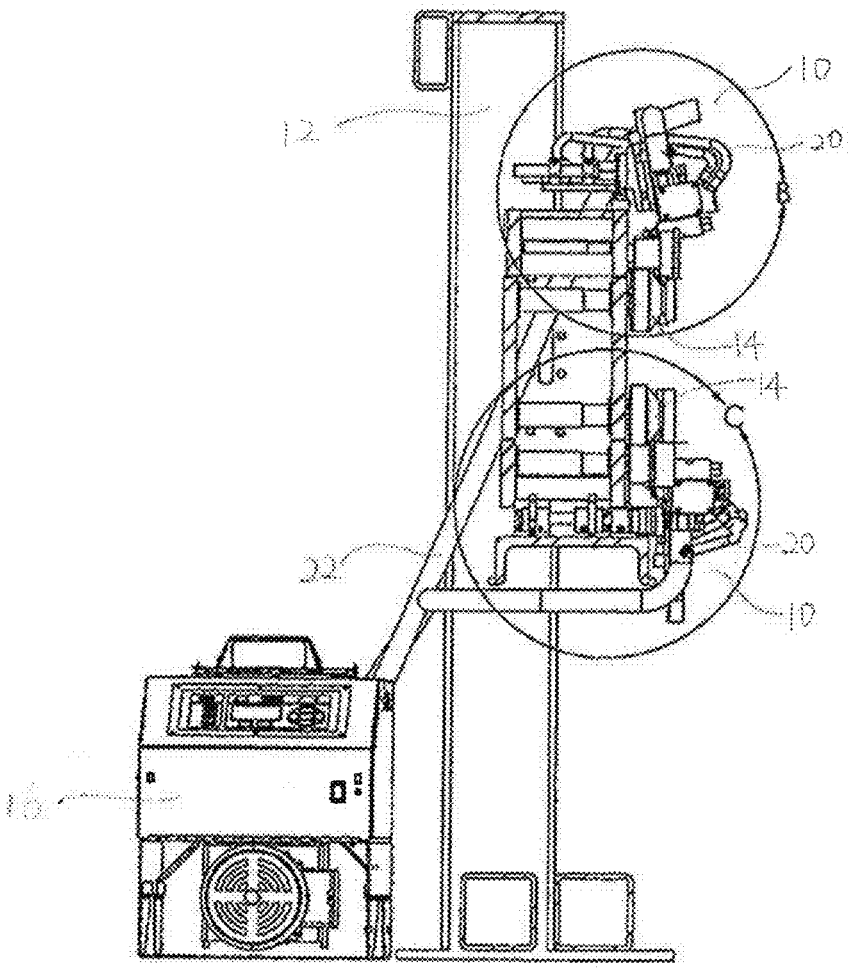
FIG. 7 is a side elevational view of a sealant system in accordance with one embodiment of the present invention.

FIG. 7 is a side elevational view of a sealant system in accordance with one embodiment of the present invention. The control module 16 incorporates a user interface 17 including an array of user controls. The user interface 17 is electrically connected to the control module 16 and is capable of receiving information regarding the sealant.

Figure 8:
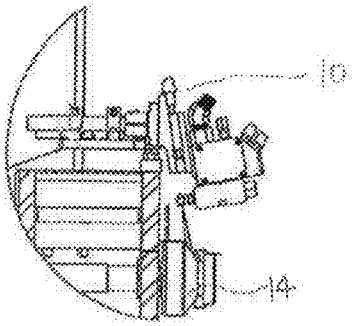
FIG. 8 is a detail, sectional side view of a sealant application unit and upper cam roller of the present invention.

FIG. 8 is a detail, sectional side view of a sealant application unit and upper cam roller of the present invention.

Figure 9:
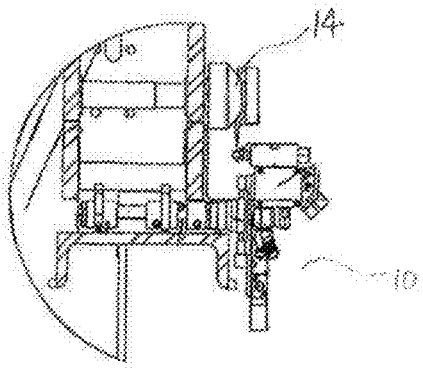
FIG. 9 is a detail, sectional side view of a sealant application unit and lower cam roller of the present invention.

FIG. 9 is a detail, sectional side view of a sealant application unit and lower cam roller of the present invention.

Figure 10:
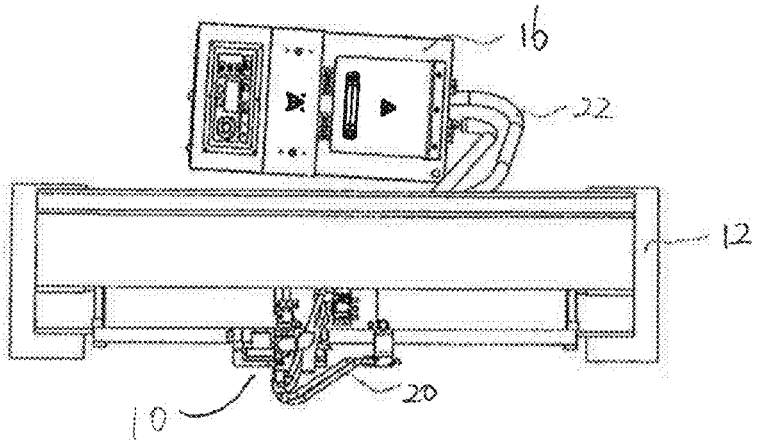
FIG. 10 is a top plan view of a sealant system in accordance with one embodiment of the present invention.

FIG. 10 is a top plan view of a sealant system in accordance with one embodiment of the present invention.

In general, therefore, the present invention provides a sealant system that:

A) Has been designed to specifically apply a heated sealant media to the pocket of a roll formed profile;

B) Where the sealant will reside in that pocket of the rollform profile until a mating metal piece is assembled into the pocket of that rollform profile. Sealant serves as a media whereby air cannot be released between the two mated pieces of metal;

C) Is specifically placed within the rollformer to apply the appropriate amount of material within the rollform profile as the profile is being formed in the roller tooling;

D) Arranges the longitudinal and latitudinal and height location of the nozzle assembly of the sealant system, as such orientation is critical to placement of the sealant media E) Utilizes a bracket specifically designed to keep the sealant hose and nozzle out of the way of the metal workpiece transferring through the reformer tooling. The bracket was designed specifically to hold tightly to the rollformer's head plate; and F) Was designed specifically to be installed by a person who is not trained in the trade.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A sealant system for operation with a metal workpiece, comprising frame;

a cam assembly mounted to said frame for receiving and holding said metal workpiece;

a sealant reservoir for housing a sealant;

a sealant application unit connected to said sealant reservoir; and a control module for coordinating operation of said cam assembly and said sealant reservoir;

wherein said control module comprises a temperature sensor for monitoring the temperature of said sealant;

an integrated heating system for heating said sealant; and a controller in communication with said temperature sensor and said integrated heating system.

* * * * *